US005651621A

United States Patent [19]

Ishimizu et al.

[11] Patent Number: 5,651,621

[45] Date of Patent: Jul. 29, 1997

[54] WIRE DOT PRINT HEAD WITH PRINT WIRES FIXED TO TIP PORTIONS OF ARMATURES DIFFERENTIATED IN RESILIENCY

[75] Inventors: Hideaki Ishimizu; Toshiyuki Asaka; Yoichi Umezawa; Takanori Mimura, all of Tokyo, Japan

[73] Assignee: Oki Electric Industry Co., Ltd., Tokyo, Japan

[21] Appl. No.: 498,889

[22] Filed: Jul. 6, 1995

[30] Foreign Application Priority Data

Jul. 19, 1994 [JP] Japan ..... 6-190106

[51] Int. Cl.[6] ..... B41J 2/28

[52] U.S. Cl. ..... 400/124.21; 400/124.04; 400/124.2

[58] Field of Search ..... 400/124.04, 124.17, 400/124.18, 124.19, 124.2, 124.21, 124.22, 124.23

[56] References Cited

U.S. PATENT DOCUMENTS

| | | | |
|---|---|---|---|
| 4,548,522 | 10/1985 | Harada et al. | 400/124.21 |
| 4,669,898 | 6/1987 | Yeh et al. | 400/124.21 |
| 4,704,041 | 11/1987 | Hayashi et al. | 400/124.21 |
| 4,934,848 | 6/1990 | Hayashi et al. | 400/124.2 |
| 4,986,676 | 1/1991 | Kimura et al. | 400/124.23 |
| 4,988,222 | 1/1991 | Yamamoto et al. | 400/124.23 |

FOREIGN PATENT DOCUMENTS

| | | | |
|---|---|---|---|
| 2-3335 | 1/1990 | Japan | 400/124.2 |
| 2-032858 | 2/1990 | Japan | 400/124.21 |
| 2-190346 | 7/1990 | Japan | 400/124.23 |
| 5-338214 | 12/1993 | Japan | 400/124.21 |
| 6-135019 | 5/1994 | Japan | 400/124.21 |

*Primary Examiner*—David A. Wiecking

*Attorney, Agent, or Firm*—Panitch Schwarze Jacobs & Nadel, P.C.

[57] ABSTRACT

Resiliency of a flat spring 7 corresponding to an end print wire 12 is set to be greater than that corresponding to a central print wire 12 by varying width of an effective spring portion 7b of a flat spring piece 7A to which an armature 13 is attached depending on positions of corresponding tips of the print wires 12. Distance between a magnet yoke 5 and a core 15 provided between the flat spring 7 and a permanent magnet 4 at a position corresponding to a central print wire 12 side is set to be smaller than that at a position corresponding to an end print wire 12 side by varying it depending on positions of corresponding tips of the print wires 12.

6 Claims, 10 Drawing Sheets

(W1 > W2)

(W1 > W2)

( d < D )

WIRE DOT PRINT HEAD WITH PRINT WIRES FIXED TO TIP PORTIONS OF ARMATURES DIFFERENTIATED IN RESILIENCY

BACKGROUND OF THE INVENTION

1. Field of the Invention

The present invention relates to a wire dot print head for use in an impact printer.

2. Description of the Related Art

There is a prior art impact printer on which a wire dot print head is mounted for performing printing by print wires. According to this wire dot print head, print wires are fixed to tip portions of armatures each attached to a free end of a flat spring. The armatures are attracted to cores owing to magnetic flux of a permanent magnet. Coils forming electromagnets confronting the armatures are energized during printing so as to cancel the magnetic flux of the permanent magnet for releasing the armatures so that each print wire is protruded. A platen is disposed to confront the print head, and the protruded print wire strikes against the platen by way of an ink ribbon and a print medium, so that printing is performed.

The platen is normally cylindrical so as to smoothly feed the print medium. The print head performs printing while moving in an axial direction of the platen. The print wires are arranged in two columns in the direction to cross at right angles with the axial direction of the platen at a tip portion of the print head (through which each print wire protrudes) confronting the platen. The print wires positioned at both ends of two arrays (hereinafter referred to as end print wires) and those positioned at central portions of two arrays (hereinafter referred to as central print wires) are differentiated in strokes extending to the platen. Each stroke extending from the end print wire to the platen is longer than that extending from the central print wire to the platen. Accordingly, the end and central print wires are differentiated in time needed for reaching the platen during printing, wherein it takes longer time for the end print wire to reach the platen compared with the central print wire to reach the platen. Therefore, in case of driving the end print wire, a driving time is set to be longer than that of the central print wire so as to adjust timing, which leads to a great loss of power.

Since the end print wire is slower than the central print wire in time needed for returning to an original position from the platen, the print head may start moving before the end print wire completely returns to the original position during printing at high speed, the end print wire is liable to be caught by an ink ribbon. Furthermore, since the end print wire needs to be driven continuously when an underline is printed, printing speed needs to be reduced, which causes a problem of reduction of printing speed as a whole.

SUMMARY OF THE INVENTION

It is an object of the present invention to provide a wire dot print head capable of improving print quality.

It is another object of the present invention to provide a wire dot print head which is excellent in power consumption rate with slight loss of power.

It is still another object of the present invention to provide a wire dot print head which prevents print wires from being caught by an ink ribbon.

It is further object of the present invention to provide a wire dot print head which prevents printing speed from being reduced as a whole.

To achieve the above objects, the wire dot print head comprises print wires fixed to tip portions of armatures each attached to a flat spring, tip portions of the armatures being attracted to the cores, around which coils are wound, by magnetic flux of a permanent magnet so as to bend the flat spring, wherein the magnetic flux of the permanent magnet is canceled when the coils are energized so that the armatures are released to permit each print wire to protrude from a tip of the print head to perform printing, and wherein the armatures are differentiated in resiliency of the corresponding flat spring and magnetic attraction applied thereto depending on positions of corresponding tips of the print wires.

It is preferable to set the resiliency and magnetic attraction to increase toward an end print wire side and decrease toward a central print wire side.

With the arrangement of the wire dot print head of the present invention, since resiliency of the flat spring and magnetic attraction to be applied to the armature corresponding to the end print wire are greater than those corresponding to the central print wire, the end and central print wires perform substantially the same repetitive operations although they are differentiated in strokes extending to the platen, which allows the coils to be energized for the same time so that a quick repeatability can be obtained compared with the conventional one.

PREFERRED EMBODIMENT OF THE INVENTION

A wire dot print head according to a preferred embodiment of the present invention will be described now with reference to the attached drawings. Elements which are common to the drawings are denoted at the same numerals.

Figure 1:
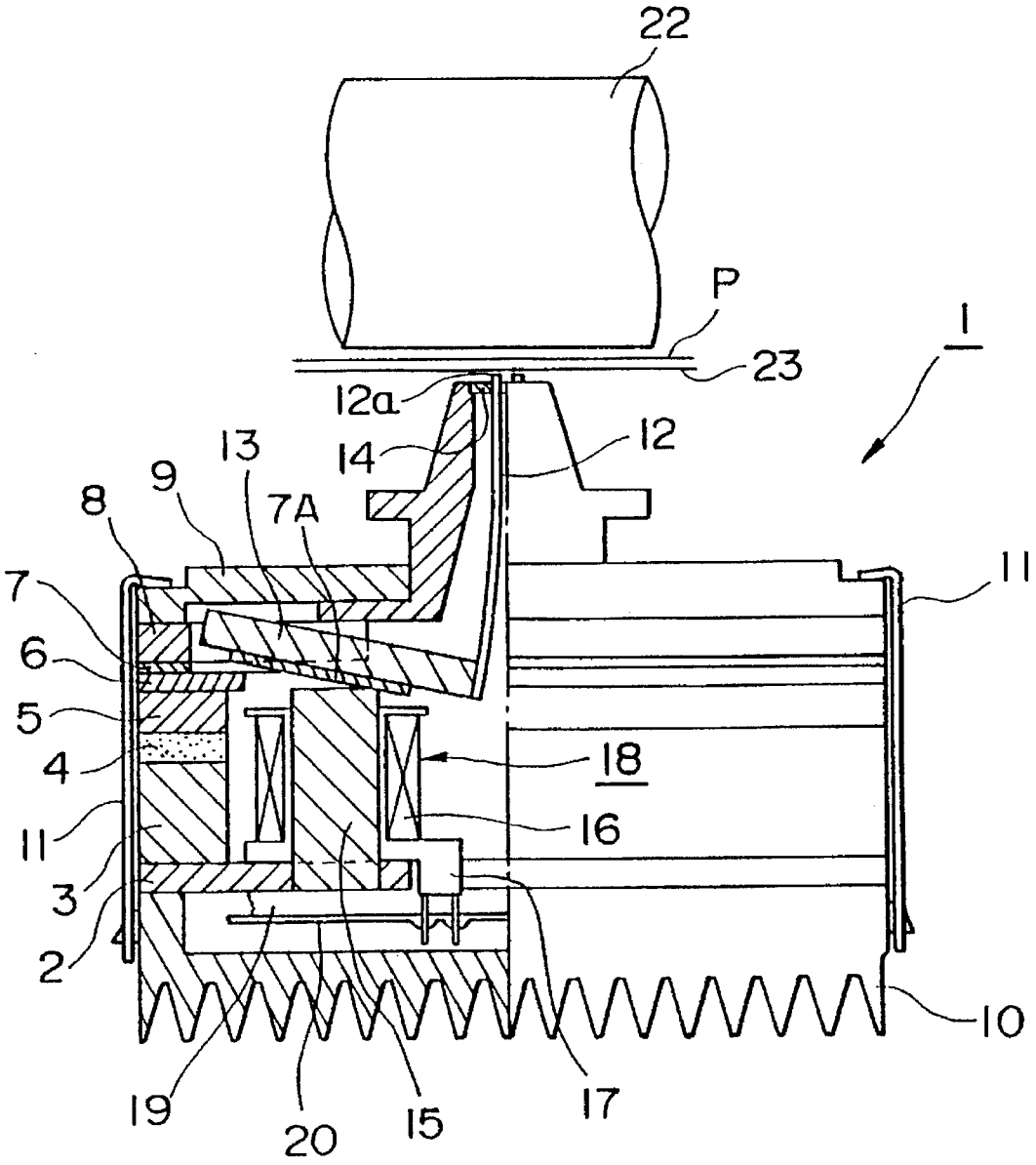
FIG. 1 is a side view of a print head according to a preferred embodiment of the present invention.

FIG. 1 is a side view of a wire dot print head 1 in which a left half thereof is shown by a cross section.

In FIG. 1, the wire dot print head (hereinafter simply referred to as a print head) 1 comprises, as shown from an external appearance, a first yoke 3, a permanent magnet 4, a magnet yoke 5, a spacer 6, a flat spring 7, and an armature yoke 8 which are layered in this order on one surface of a base plate 2 (upper side in FIG. 1). The print head 1 further comprises a guide frame 9 disposed on the armature yoke 8, a cap 10 provided on the other surface of the base plate 2 (lower side in FIG. 1), and a clamp 11 for fixing these elements between the guide frame 9 and the cap 10 so as to form an integral unit.

Figure 2:
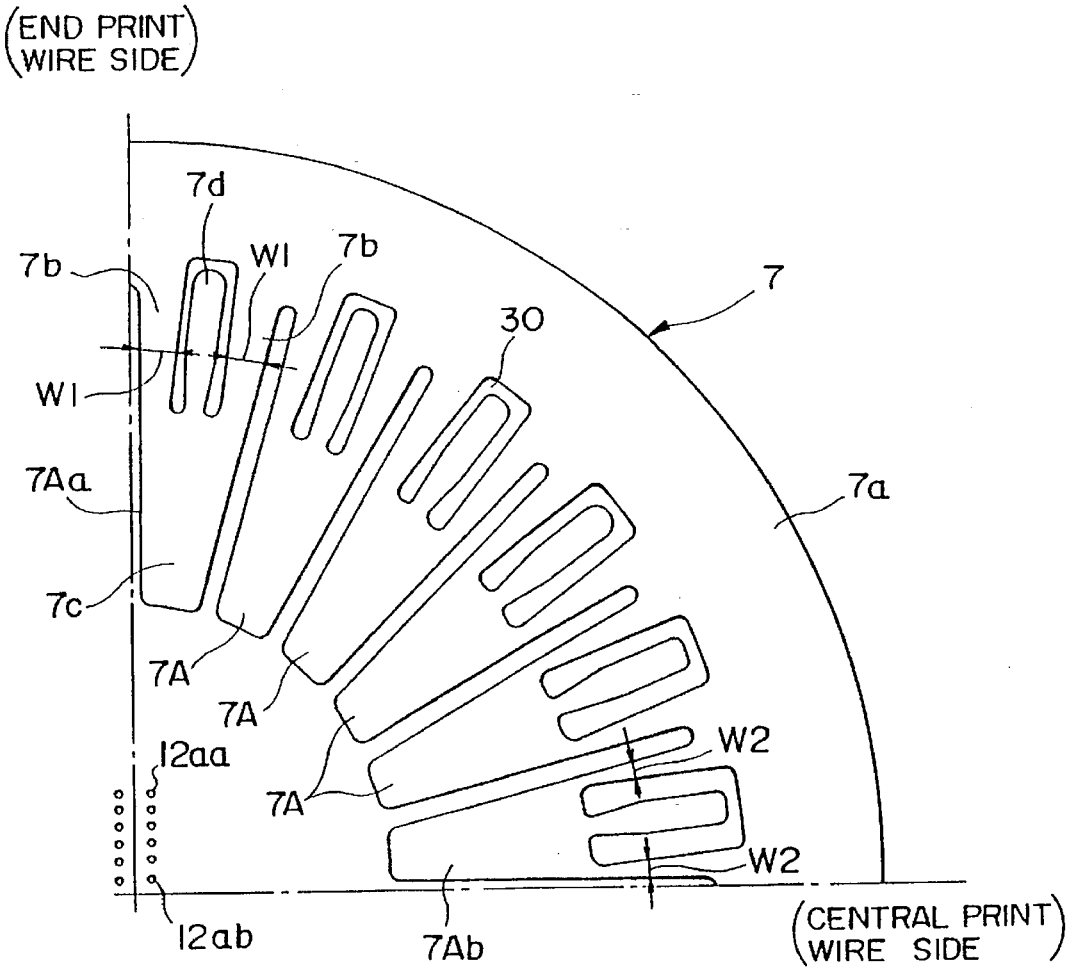
FIG. 2 is a plan view showing a main portion of a flat spring of the print head of FIG. 1.

An internal structure of the print head 1 will be described now. The flat spring 7 comprises a spring body 7*a* which is substantially annular as shown in FIG. 2, and a plurality of biasing flat spring pieces 7A which are the same as the print wires in numbers and extend from an inner circumferential surface of the spring body 7*a* to a central portion of the print head 1 like a cantilever. Armatures 13 are fixed to free ends of flat spring pieces 7A and print wires 12 are attached to tip portions of the armatures 13. A tip 12*a* of each print wire 12 is guided by a guide 14 of the guide frame 9 so as to protrude from a tip of the print head 1 toward a cylindrical platen 22. An ink ribbon 23 and a paper P are disposed between the print head 1 and the platen 22 wherein printing is performed on the paper P when the tip 12*a* of the print wire 12 is protruded.

A core 15 is provided vertically on the base plate 2 confronting each armature 13 (or the flat spring piece 7A). A bobbin 17 around which a coil 16 is wound is mounted on each core 15. An electromagnet 18 is formed by the core 15 and coil 16. The coil 16 is soldered to a printing circuit plate 20 disposed on the other surface of the base plate 2 by way of a positioning space sheet 19.

A more detailed structure of the print head 1 will be described now with reference to FIGS. 1 to 4, Each flat spring piece 7A provided to extend from the inner circumferential surface of the spring body 7*a* of the flat spring 7 is notched in a U-shape at the central portion thereof to form a notched portion 30, thereby forming an effective spring portion 7*b* provided at both sides of the notched portion 30, a front end fixing portion 7*c* for fixing the armature 13 thereto, and a rear end fixing portion 7*d*. Each width W of the effective spring portion 7*b* of the flat spring piece 7A is set in such a way that a flat spring piece 7A*a* located at the position corresponding to the tip 12*aa* of the end print wire 12 has the largest width W1 while a flat spring piece 7A*b* located at the position corresponding to the tip 12*ab* of the central print wire 12 has the smallest width W2, as shown in FIG. 2 showing the quartered flat spring 7. That is, the width W of the effective spring portion 7*b* of each flat spring piece 7A is formed relatively larger toward the end print wire 12 side and is gradually smaller toward the central print wire 12 side. The width W2 of the flat spring piece 7A corresponding to the central print wire 12 side is set to be the smallest.

On the other hand, each armature 13 comprises a fixing portion 13*a* which is placed to bridge the front end fixing portion 7*c* and rear end fixing portion 7*d* of the flat spring piece 7A and a lever portion 13*b* which extends from and is integrated with the fixing portion 13*a* and has the print wire 12 at a tip portion thereof. The fixing portion 13*a* is welded and fixed to the flat spring piece 7A at positions denoted at x in FIG. 4.

The spacer 6 is formed annularly like the first yoke 3 and permanent magnet 4. An outer diameter portion 6*b* of the spacer 6 has substantially the same dimension as the outer diameter of the permanent magnet 4, and an inner diameter portion 6*b* of the spacer 6 has a size to exceed the flat spring piece 7A of the flat spring 7 and extend to a part of the effective spring portion 7*b* of the flat spring 7.

The armature yoke 8 is formed annularly like the spacer 6. An inner diameter portion 8*a* is in a state to correspond to a part of the front end fixing portion 7*c* of the flat spring piece 7A. A groove 31 is defined by notching the armature yoke 8 in the direction from the inner diameter portion 8*a* toward an outer diameter portion 8*b* at a position corresponding to the fixing portion 13*a* of the armature 13. The groove 31 has such a size that it can receive the fixing portion 13*a* of the armature 13 with a slight gap between it and the fixing portion 13*a*.

Figure 3:
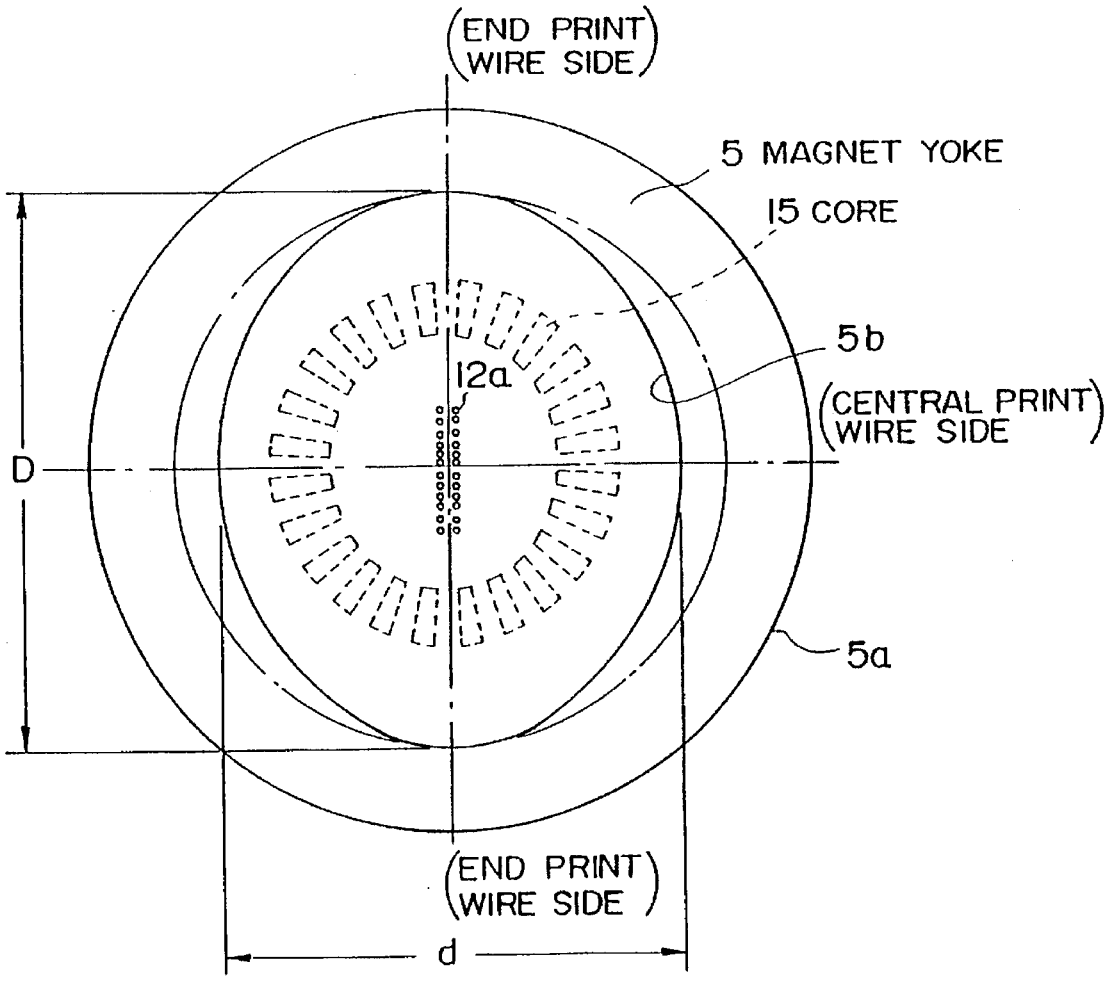
FIG. 3 is a view showing an arrangement of a main portion of the print head of FIG. 1.

The magnet yoke 5 is also formed annularly. As shown in FIG. 3, an outer diameter portion 5*a* of the magnet yoke 5 is formed in a perfect circular shape in conformity with the flat spring piece 7A of the flat spring 7, and an inner diameter portion 5*b* of the magnet yoke 5 is formed in an elliptical shape having a long diameter D in the vertical direction and a short diameter d in the horizontal direction. The cores 15 positioned upward and downward in FIG. 3 correspond to the end print wires 12 while the cores 15 positioned leftward and rightward correspond to the central print wires 12. Accordingly, the inner diameter portion 5*b* of the magnet yoke 5 is positioned to approach closer to the cores 15 in the direction from the end print wire 12 side to the central print wire 12 side.

An operation of the print head 1 will be described now.

In the print head 1 of the present invention, there is always formed a magnetic circuit in which magnetic flux of the permanent magnet 4 passes through the magnet yoke 5, the spacer 6, the armature yoke 8, the armature 13, the core 15, the base plate 2 and the first yoke 3 and returns to the permanent magnet 4. During a normal time (nonprinting time), the armatures 13 are attracted to end surfaces of the cores 15 so as to bend the flat spring pieces 7A so that distortion energy is accumulated in the flat spring pieces 7A.

In this state, if the coil 16 is energized to generate magnetic flux in the core 15 flowing direction of which is opposite to that of the magnetic flux of the permanent magnet 4, the magnetic attraction to be applied to the armature 13 is reduced. As a result, the armature 13 is released together with the flat spring piece 7A owing to the distortion energy accumulated in the flat spring piece 7A so that the tip 12*a* of the print wire 12 attached to the tip portion of the armature 13 protrudes from the tip of the print head 1 through the guide 14 of the guide frame 9 so as to impact the platen 22 by way of the ink ribbon 23 and the paper P. This operation is performed in each print wire 12 corresponding to each electromagnet 18, thereby enabling the print wire 12 to print characters and graphic patterns.

Figure 4:
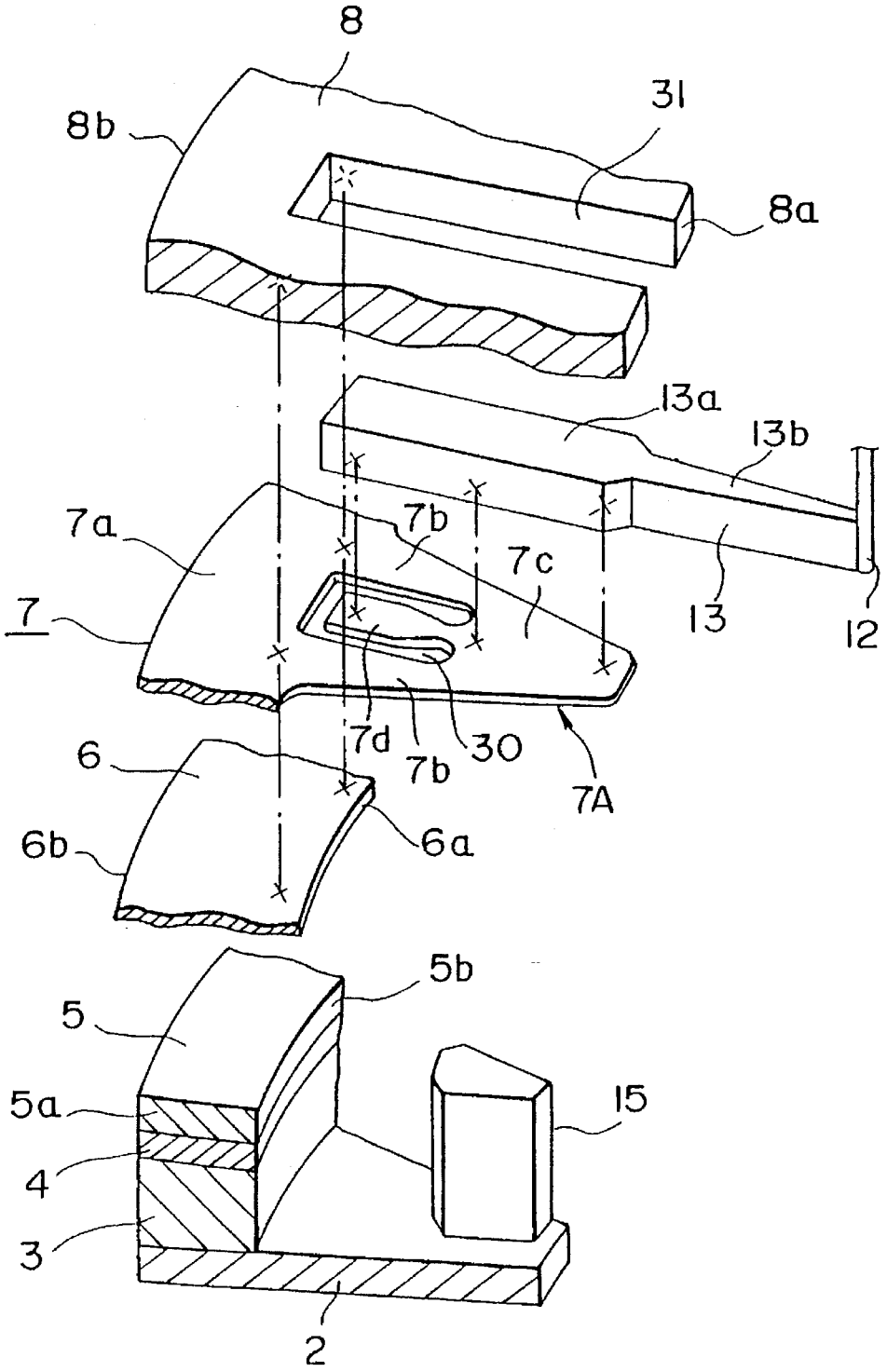
FIG. 4 is another exploded perspective view showing the main portion of the print head of FIG. 1.
Figure 5:
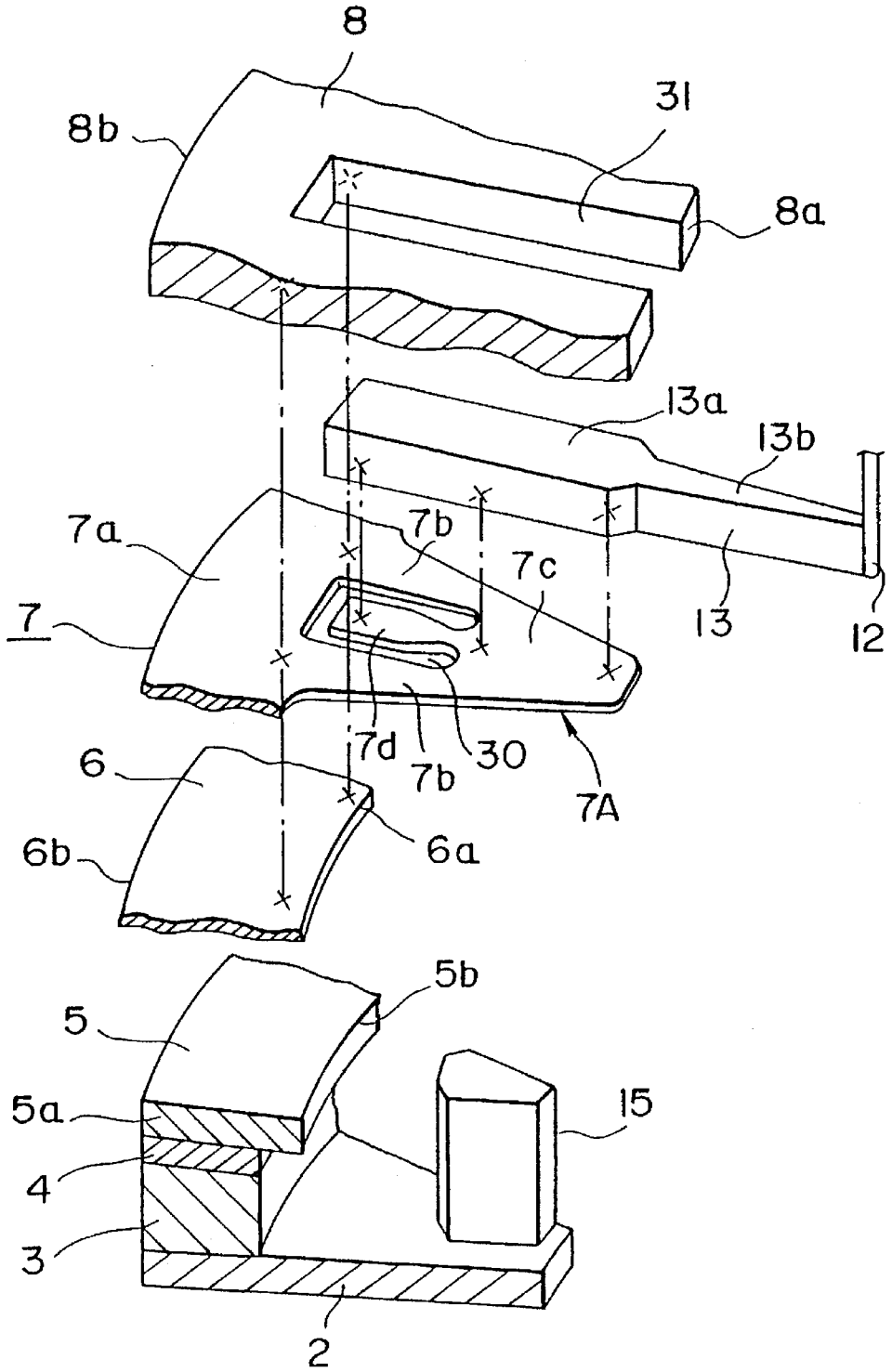
FIG. 5 is still another exploded perspective view of the main portion of the print head of FIG. 1.
Figure 6:
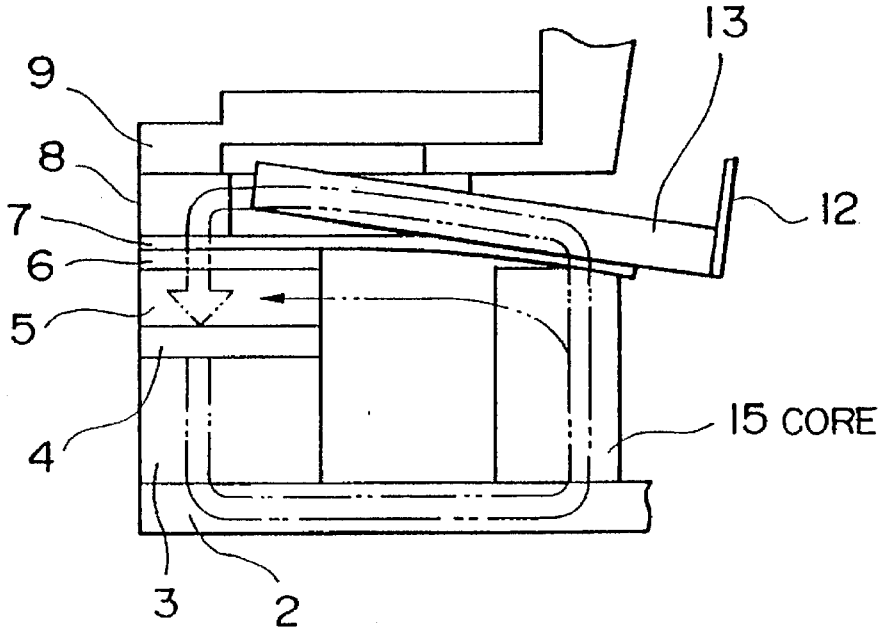
FIG. 6 is a view typically showing a flow passage of magnetic flux in the print head of FIG. 1.
Figure 7:
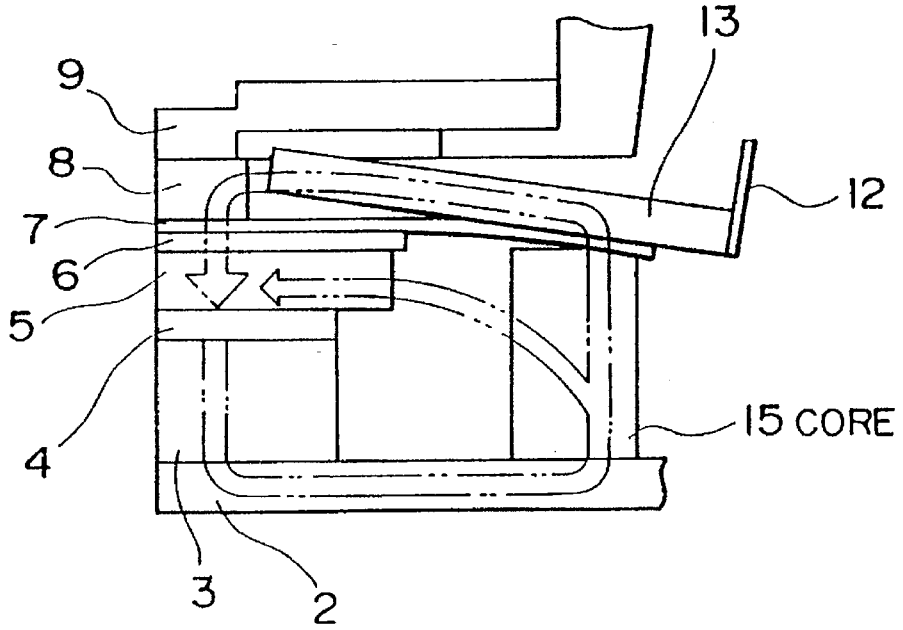
FIG. 7 is a view typically showing another flow passage of magnetic flux in the print head of FIG. 1.

According to the preferred embodiment, the widths W of the effective spring portions 7*b* of the flat spring pieces 7A are varied depending on the positions of the tips 12*a* of the print wires 12, namely, they are relatively larger toward the end print wire 12 side, but smaller toward the central print wire 12 side. Accordingly, the resiliency of the flat spring pieces 7A is larger toward the end print wire 12 side while it is smaller toward the central print wire 12 side. The inner diameter portion 5*b* of the magnet yoke 5 is structured to be farther from the core 15 at the position corresponding to the end print wire 12 side (as shown in FIG. 4 and 6) but it approaches the core 15 at the position corresponding to the central print wire 12 side (as shown in FIGS. 5 and 7). Accordingly, as shown in FIG. 6, a gap between the core 15 and magnet yoke 5 is larger toward the end print wire 12 side so that most of the magnetic flux passing through the core 15 flows toward the armature 13, thereby allowing the magnetic attraction to be applied to the armature 13 to be large during a normal time, i.e. nonprinting time. On the other hand, as shown in FIG. 7, a gap between the core 15 and magnet yoke 5 is smaller toward the central print wire 12 side, so that a part of the flux passing through the core 15 does not pass through the armature 13 and flows toward the magnet yoke 5, thereby allowing the magnetic attraction to be applied to the armature 13 to be small during the normal time, i.e. nonprinting time.

Figure 8:
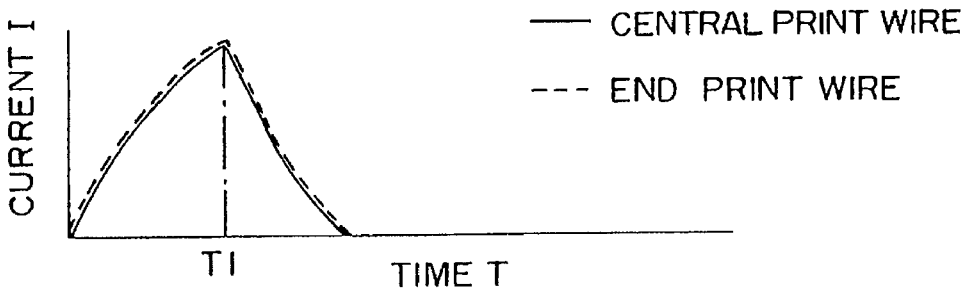
FIG. 8 is a graph showing a characteristic of the print head.
Figure 9:
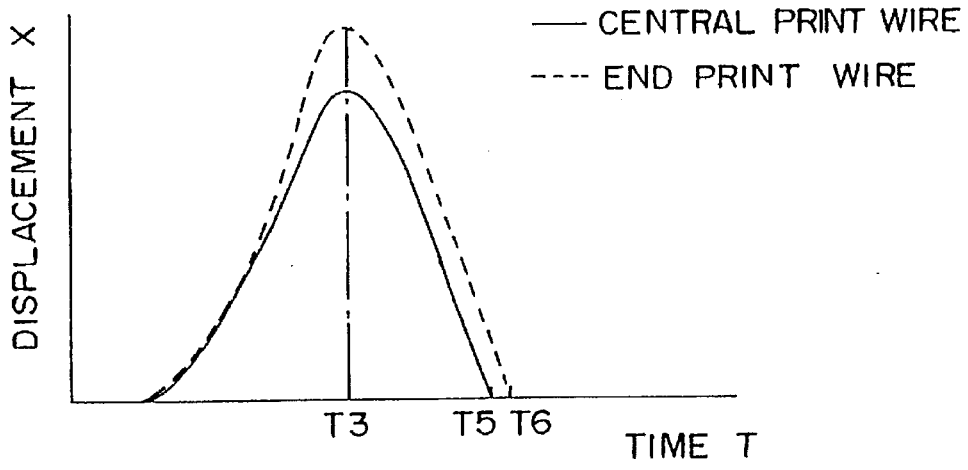
FIG. 9 is a graph showing another characteristic of the print head.

FIG. 8 shows waveforms of current to be applied to the coils 16 corresponding to the end and central print wires 12 when the coils 16 are energized, and FIG. 9 shows displacement of the tips 12*a* of the end and central print wires 12. In FIG. 8, a vertical axis shows a current I to be applied to the coils 16 and a horizontal axis shows time. In FIG. 9, a vertical axis shows each displacement x of the tips of the print wires and a horizontal axis shows time. In FIGS. 8 and 9, solid lines show a case of the end print wire and dotted lines show a case of the central print wire.

In FIGS. 8 and 9, when the coil 16 is energized, the magnetic flux is generated in the direction opposite to that of the permanent magnet 4, thereby reducing the magnetic attraction to be applied to the armature 13. When the resiliency of the flat spring 7 exceeds this magnetic attraction, the armature 13 is released so that the print wire 12 begins to be displaced. Since the end print wire 12 is greater than the central print wire 12 in both resiliency and magnetic attraction, the former is the same as the latter in time needed from the start of energization of the coil 16 to the start of operation of the print wire 12. However, when the magnetic attraction is reduced owing to the generation of magnetic flux in the core in the direction opposite to the flow of the magnetic flux of the permanent magnet, the end print wire 12 is displaced faster than the central print wire 12 and it reaches the platen 22 at the same time T3 as the central print wire 12 does since the resiliency applied to the end print wire 12 is greater than that applied to the central print wire, thereby performing printing. Accordingly, the time T1 to energize the coil 16 is the same in both the end and central print wires 12. Regarding time needed for returning of the same to a waiting position (initial position) after striking of the tip end 12*a* of the print wire 12 against the platen 22, it takes longer time (T6–T3) for the end print wire 12 to return to the waiting position compared with the central print wire 12 to return to the waiting position since the magnetic attraction and the resiliency to be applied to the former is greater than those to be applied to the latter.

Accordingly, there is no substantial difference in printing speed between the end and central print wires 12. At the same time, the time to energize the coil 16 corresponding to the end print wire 12 is also reduced, so that the energizing time is common to all print wires 12.

As mentioned above in detail, according to the preferred embodiment, since the width W of the effective spring portion 7*b* of the flat spring piece 7A is set to be gradually larger in the direction from the central print wire 12 side toward the end print wire 12 side and the distance between the magnet yoke 5 and core 15 is set to be gradually larger in the direction from the central print wire 12 side toward end print wire 12 side corresponding to the cores 15, the time to energize the coil 16 becomes the same in both the central and end print wires 12, and further a quick repeatability can be obtained. Accordingly, it is possible to obtain a print head capable of performing high-speed printing with low voltage and high quality while all the print wires 12 are subjected to the same printing control without paying attention to the difference of strokes between the central and end print wires 12.

Figure 10:
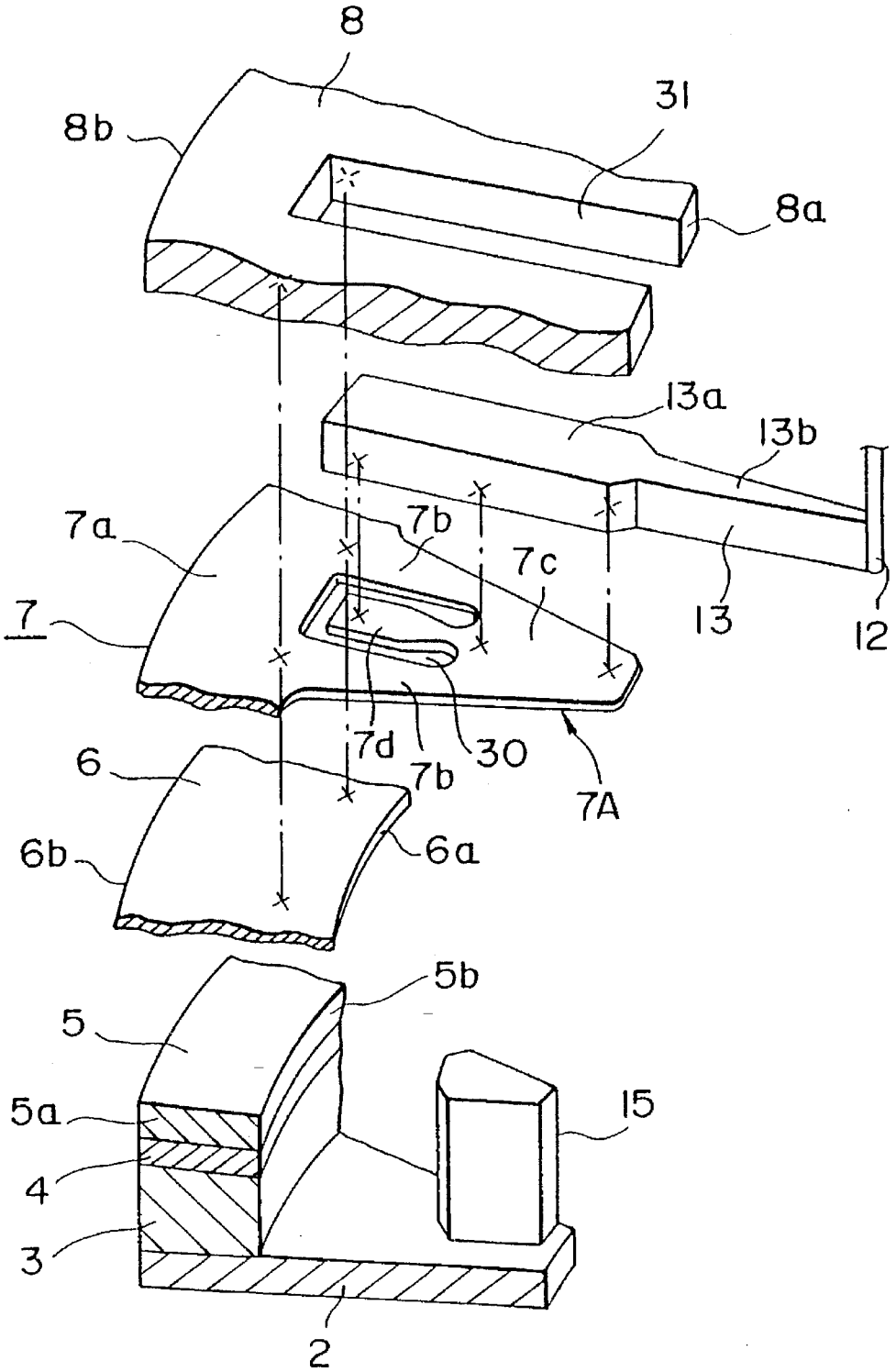
FIG. 10 is an exploded perspective view showing a main portion of a print head according to a modification of the present invention.
Figure 11:
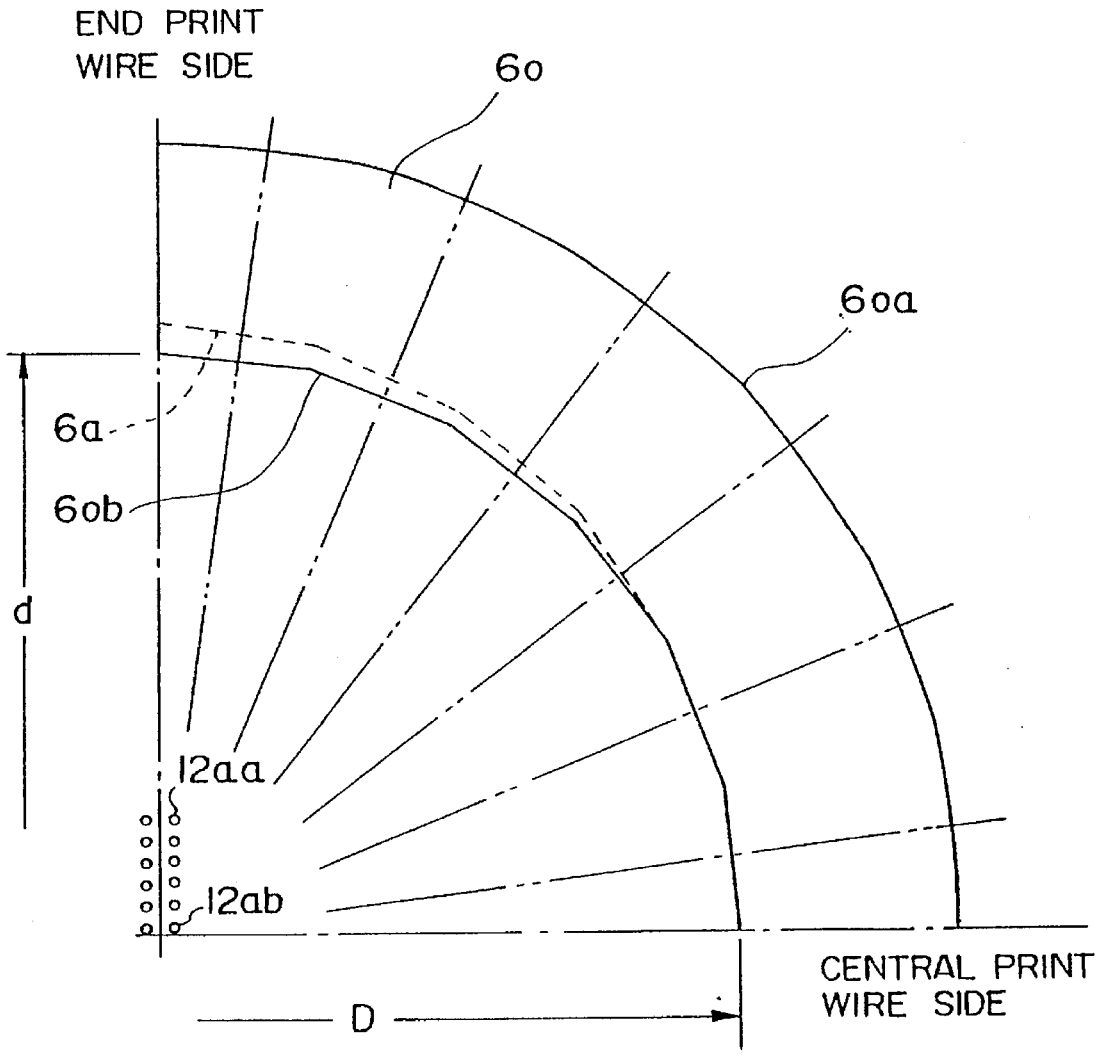
FIG. 11 is a plan view of a main portion of a spacer of the print head of FIG. 10.

A modification of the present invention will be described now with reference to FIGS. 10, 11 and 12, in which FIG. 10 is an exploded perspective view of a main portion of a print head according to the modification, and FIG. 11 shows a quartered spacer in the modification. This modification varies a structure of the spacer 6 of the preferred embodiment. That is, in FIGS. 10 and 11, an outer diameter portion 60*a* of a spacer 60 is formed annularly like the magnet yoke 5 and flat spring 7. A base end portion 60*b* at an inner diameter portion of the spacer 60 is formed to have an inner diameter D. The inner diameter D is substantially the same as an inner diameter of the permanent magnet 4 at the central print wire 12 side, gradually decrease toward the end print wire 12 side, and approaches closest to the core 15 at a position corresponding to the end print wire 12 side. In FIG. 11, an inner portion 6*a* of the spacer 60 as denoted at dotted line shows the embodiment described above. Meanwhile, the effective spring portions 7*b* of the flat spring pieces 7A are formed to be the same in widths thereof without varying the widths in both the end and central print wire sides.

Figure 12:
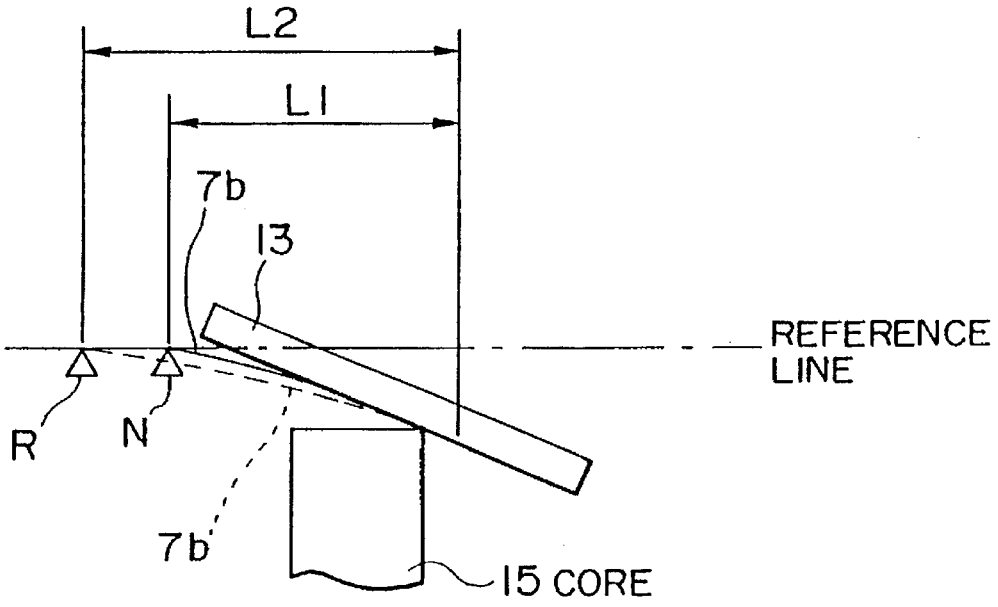
FIG. 12 is a view showing an operation of a main portion of the print head of FIG. 10.

FIG. 12 shows an operating state where the magnetic attraction is applied to the armature 13 at the end print wire 12 side and an operating state where the magnetic attraction is applied to the armature 13 at the central print wire 12 side. In the same figure, dotted line shows the flat spring 7 corresponding to the central print wire 12 and the solid line shows the flat spring 7 corresponding to the end print wire 12.

The base end portion 60*b* of the spacer 60 gets gradually closer to the core 15 in the direction from the central print wire 12 side toward the end print wire 12 side. A fulcrum about which the flat spring piece 7A turns (hereinafter referred to a turning fulcrum) gets gradually closer to the core 15 in the direction from the central print wire 12 side toward the end print wire 12 side. In a case where the turning fulcrum of the flat spring piece 7A approaches closest to the core 15 (a position as denoted at N in FIG. 12 in case of the end print wire 12), and in a case where the turning fulcrum of the flat spring piece 7A is the farthest from the core 15 (a position as denoted at R in FIG. 12 in case of the central print wire 12), a length L1 of the effective spring portion 7*b* of the flat spring piece 7A corresponding to the end print wire 12 is less than a length L2 of that corresponding to the central print wire 12 (L1<L2) although bending amount of the flat spring piece 7A is the same in both cases.

Resiliency W of a cantilever spring having a fixed end is generally expressed as follows.

$$W=(3\cdot E\cdot I\cdot X)/L^3 \quad (1)$$

where L is the length of the effective spring portion 7*b*, E is a longitudinal elastic modulus, I is moment of inertial of the cross section and x is displacement. Supposing that amount of displacement is same, the longer the length of the effective spring portion 7*b* is, the larger the resiliency W is.

Accordingly, when the base end portion 60*b* of the spacer 60 corresponding to the end print wire 12 is approached to the core 15, the resiliency of the flat spring piece 7A corresponding to the end print wire 12 can increase, so that magnitude of the resiliency of the flat springs 7 can be varied at the end and central print wire 12 sides without varying the widths of the effective spring portions 7*b* of the flat spring pieces 7A although these widths are varied in the preferred embodiment.

Therefore, it is possible to permit the time to energize the coil 16 to be the same in both the end and central print wires 12 so as to obtain more quick repeatability since this modification has such a structure that the distance between the inner diameter portion of the magnet yoke 5 and the core 15 is gradually larger in the direction from the central print wire 12 side toward the end print wire 12 side, and the distance between the base end portion 60*b* of the spacer 60 and the core 15 is gradually smaller in the direction from the central print wire 12 side toward the end print wire 12 side so as to permit the base end portion 60*b* to get closer to the core 15.

In this modification, although all the flat spring pieces 7A have the effective spring portions 7*b* of the same widths, the flat spring pieces 7A may be structured in a combination of the aforementioned structure and the structure of the preferred embodiment, namely, the width of the effective spring portion 7*b* is larger toward the end print wire 12 side and is gradually smaller toward the central print wire 12 side, and the width of the effective spring portion 7*b* is the smallest in the most central print wire 12 side.

What is claimed is:

1. A wire dot print head 1 comprising:

a number of print wires 12;

a like number of armatures 13, each armature having a tip portion, each print wire being fixed to a tip portion of a corresponding armature;

a like number of flat springs 7, the flat springs having varying resiliencies, each armature being attached to a corresponding flat spring;

a like number of cores 15, each core being associated with a corresponding armature;

a like number of coils 16, each coil being wound around a corresponding core; and a permanent magnet 4 creating a varying mount of magnetic attraction between each core and the tip portion of the corresponding armature such that the corresponding flat spring bends toward the core, the varying resiliency of each flat spring coinciding with the varying amount of magnetic attraction to the corresponding core, the varying resiliency of each flat spring and the varying amount of magnetic attraction to the corresponding core depending on the relative position of the corresponding print wire with respect to the print head;

wherein the magnetic attraction to any core is canceled when the corresponding coil is energized, the corresponding armature thereby being released to permit the corresponding print wire to protrude from the print head to perform printing.

2. A wire dot print head according to claim 1 wherein the print wires are substantially arranged into an elongated array having opposing ends, and wherein the varying resiliency of each flat spring and the varying amount of magnetic attraction to the corresponding core increase as the corresponding print wire approaches toward an end of the array and decrease as the corresponding print wire approaches toward a midpoint between the ends of the array.

3. A wire dot print head according to claim 2 wherein the amount of magnetic attraction to each core is set by varying a distance between the core and a magnetic yoke 5 positioned between the corresponding flat spring and the permanent magnet.

4. A wire dot print head according to claim 2 wherein each flat spring extends in an extending direction and has an effective spring portion with a width substantially perpendicular to the extending direction, the resiliency of each flat spring being set by varying the width of the corresponding effective spring portion.

5. A wire dot print head according to claim 2 wherein each flat spring extends in an extending direction and has an effective spring portion with a length substantially parallel to the extending direction, the resiliency of each flat spring being set by varying the length of the corresponding effective spring portion.

6. A wire dot print head according to claim 5 wherein the length of the corresponding effective spring portion is set by varying a distance between the core and a spacer 6 positioned between the flat spring and the permanent magnet, the spacer acting as a fulcrum about which the flat spring bends.

* * * * *